United States Patent [19]

Conde

[11] Patent Number: 4,669,531

[45] Date of Patent: Jun. 2, 1987

[54] AIR HEATER SEAL FRAME SUPPORT LINK

[75] Inventor: James C. Conde, North Royalton, Ohio

[73] Assignee: The Babcock & Wilcox Company, New Orleans, La.

[21] Appl. No.: 826,538

[22] Filed: Feb. 6, 1986

[51] Int. Cl.[4] ..... F28D 17/00

[52] U.S. Cl. ..... 165/4; 165/9

[58] Field of Search ..... 165/4, 9

[56] References Cited

U.S. PATENT DOCUMENTS

| | | | |
|---|---|---|---|
| 3,319,705 | 5/1967 | Sandmann | 165/4 |
| 3,321,010 | 5/1967 | Brandt et al. | 165/9 |
| 3,323,579 | 6/1967 | Brandt et al. | 165/4 |
| 4,114,680 | 9/1978 | Kritzler et al. | 165/4 |

FOREIGN PATENT DOCUMENTS

| | | | |
|---|---|---|---|
| 1063984 | 4/1967 | United Kingdom | 165/4 |

*Primary Examiner*—Albert W. Davis, Jr.
*Attorney, Agent, or Firm*—Robert J. Edwards

[57] ABSTRACT

A rotary regenerative air heater includes an improved intermediate linkage connecting the seal frame to the rotating hood frame. The linkage includes axially spaced plates laterally connected to each of the frames and interconnected to each other by a linkage designed to allow axial coplanar movement of the frames relative to each other.

4 Claims, 14 Drawing Figures

AIR HEATER SEAL FRAME SUPPORT LINK

BACKGROUND OF THE INVENTION

Field of the Invention

This invention relates to rotary regenerative air heaters for transferring waste heat from boiler flue gas to combustion air and, more particularly, to a new and improved linkage connected between the air heater's seal and duct hood frames.

In one type of rotary regenerative air heater, a cylindrical heat exchange mass and a containment structure, called the stator, is positioned stationary between the inlets and outlets of the air and gas ducts. The stator is a radially compartmented steel shell packed with a multiplicity of plates, arranged to provide an axial passage therethrough, such that the gas and air flow in an axial direction through the cylindrical heat exchange mass. The plates embody shapes, materials and thicknesses designed to provide optimum heat transfer, low pressure drop, resistance to corrosion, and ease of cleaning.

Air ducts at each axial end of the stator include air duct hoods, co-axially aligned with the cylindrical heat exchange mass, which are secured to a central drive shaft for co-axial rotation in relation to the cylindrical heat exchange mass. Each of the air duct hoods comprises a respective central flow inlet or outlet passage centrally mounted between, and in fluid communication with, two diametrically opposite hood segments or sectors for the passage of air to or from the heating mass. The hood segments of each of the air duct hoods are generally pie-shaped and circumferentially spaced from each other.

The gas ducts are arranged stationary, also at the opposite ends of the stator, and surround the rotating air duct hoods.

The air duct hoods, at opposite ends of the heat exchange mass, rotate synchronously so that alternate radial sectors of the mass of plates are alternately exposed to a hot flue gas stream and then cooled by a combustion air stream thereby effecting a regenerative heating and cooling cycle.

Sealing between the stationary and rotating components is achieved by articulated seal frames which are springmounted to the rotating air duct hoods. As the stator expands or contracts, the frames adapted to the stator's periphery in order to maintain an effective seal at various boiler loads. The seal frame, which extends along the peripheries of the hood segments adjacent the heat exchange mass, carries a sealing strip. The sealing strip is resiliently urged against cylindrical and radial end surfaces of the stator. During rotation of the air duct hood, the sealing strip slides along the end surfaces in sealing relationship with the stator.

An expansion joint is connected between the seal frame and the air duct hood to accommodate relative thermal displacement.

The seal frame and the air duct hood have been connected to each other by ball and socket drag linkages which transmit the driving torque and dead load forces between the air ducts and sealing frame as disclosed, for example, in U.S. Pat. Nos. 3,321,010 and 3,319,705. The linkage should allow coplanar axial movement of the ducts relative to the frame. Coplanar movement is critical to the maintenance of free rotary motion of the rotating surface relative to the stationary surface. Nonplanar movement due to thermal growth, for example, can result in seizure or intermittent binding of the rotating member. Such problems have been experienced in arrangements utilizing ball and socket drag link connections in respect of horizontal shaft regenerative air heaters having rotating duct connections and a stationary mass of steel plates for heat absorption.

SUMMARY OF THE INVENTION

According to the present invention, an improved intermediate linkage is presented for connecting the seal frame and hood frame.

The arrangement comprises a plurality of links pivotally interconnected between plates that are laterally attached to the seal and hood frames. The links are also pivotally connected to each other. The link arrangement causes coplanar movement of the frames relative to each other in the axial direction in response to changes in air heater operating conditions.

The links are preferably arranged symmetrically of lateral centerlines of the plates that are axially aligned.

Thus, in accordance with the invention, an improved intermediate linkage connects the seal frame and hood frame in a regenerative air heater. The air heater has an open-ended cylindrical shell with axially spaced cylindrical end faces, a stationary heat exchange mass mounted within the shell, air ducts co-axially mounted at each end of the shell for rotation relative to the heat exchange mass, a seal frame for sealing the air ducts in fluid-tight engagement against the end faces, and a hood frame axially spaced from the seal frame attached to each air duct. The improved intermediate linkage comprises a first plate extending laterally, relative to the axis of the shell, from the seal frame and a second plate extending laterally from the hood frame. Links are pivotally supported by and maintain the first and second plate in parallel relationship to each other for axial coplanar relative movement. In accordance with a preferred embodiment, the links comprise a first link pivotally connected at one end to the first plate, and a second link pivotally connected at one end to the second plate and pivotally connected at an opposite end to an end of the first link opposite the end of the first link which is connected to the first plate. The first plate is characterized by a pair of spaced rings, projecting from the first plate, and the first link includes a pair of tubular members and a membrane interconnected between said tubular members. One of the tubular members of the first link is mounted intermediate the spaced rings of the first plate and pivotally connected thereto by a pivot pin. The second plate comprises a tubular portion projecting from the second plate. The second link includes a first pair of spaced rings at opposite sides of the tubular portion of the second plate pivotally connected thereto by a second pivot pin. The two separate links are mounted to the first and second plates symmetrically about axially aligned lateral centerlines extending through the plates from the respective frames. The pivot pins each have an elongated axis which extends at an equal angle relative to the lateral centerlines.

DETAILED DESCRIPTION

Figure 1:
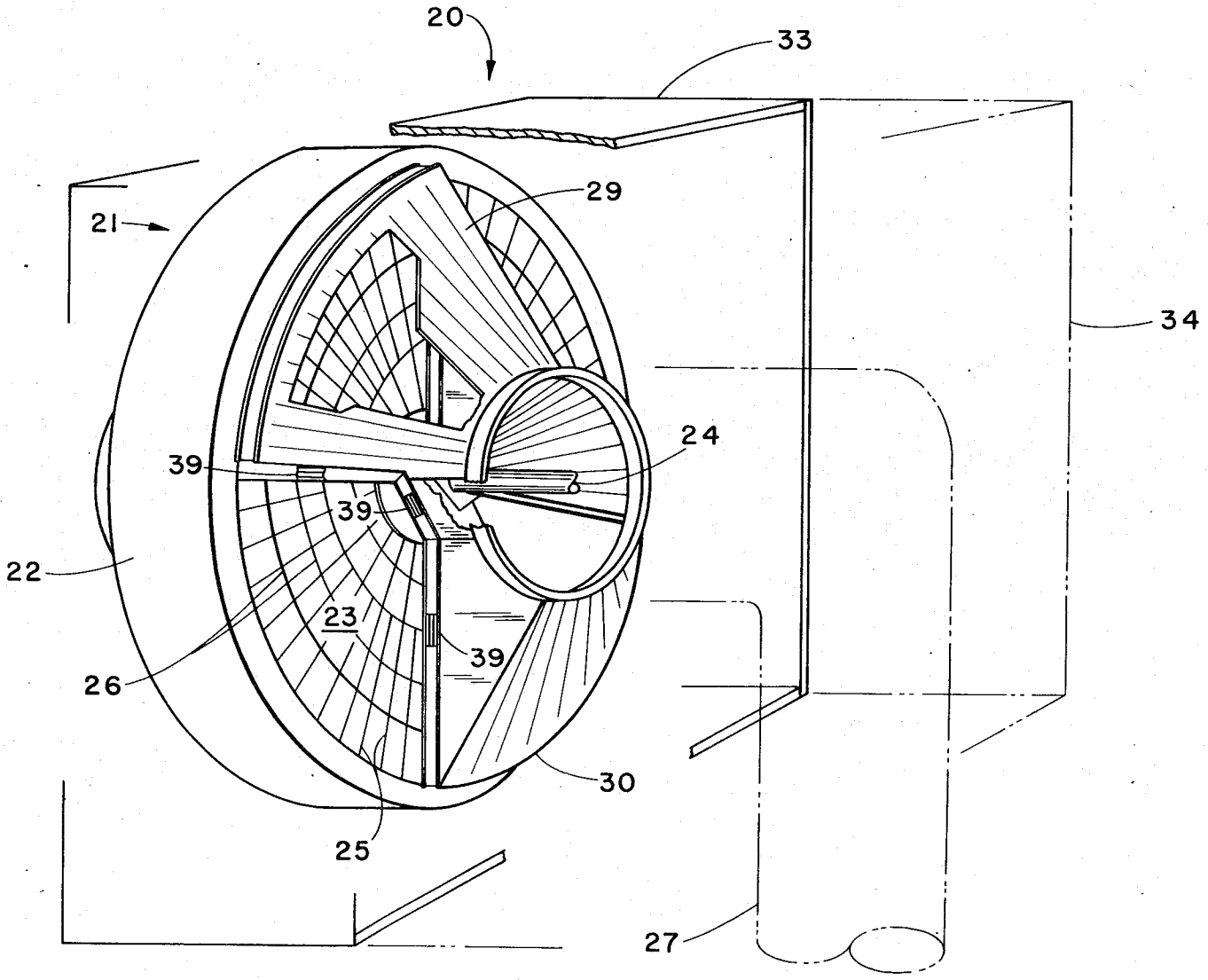
FIG. 1 is a schematic perspective view, with the outer surface of a hood segment partly broken away, illustrating the stator and the air and gas ducts at one end of an air heater, including a schematic illustration of the location of seal frame support links according to the invention.
Figure 3:
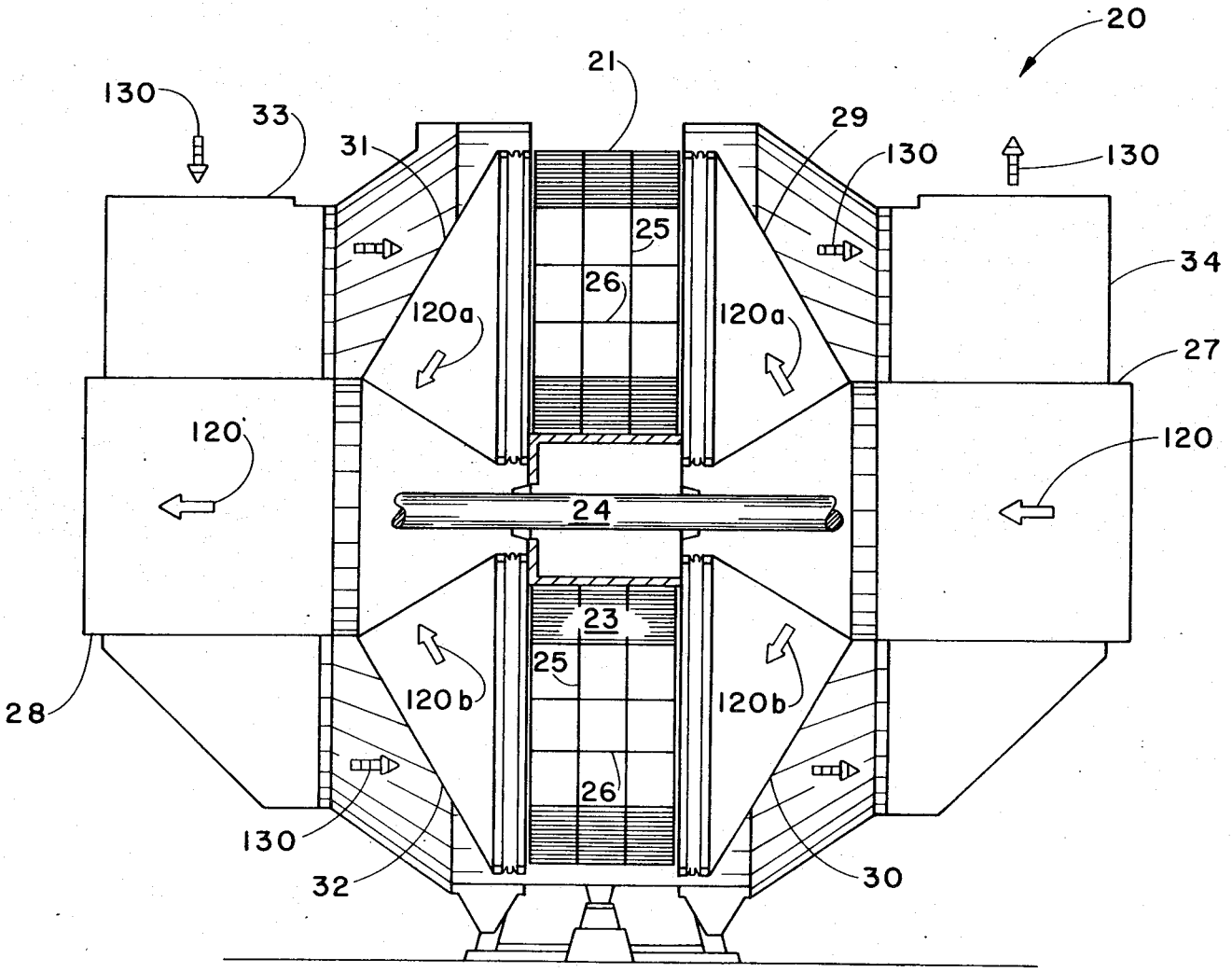
FIG. 3 is an axial sectional view of an air heater.

A horizontal shaft regenerative air heater 20 is shown in FIGS. 1 and 3. The air heater 20 includes a stator 21 which comprises an open-ended cylindrical shell 22, having cylindrical end faces, disposed about a central horizontal axis, and a heat exchange mass 23 mounted within the shell 22. The heat exchange mass 23 is composed of multiple plates that radially extend between a horizontal central shaft 24 and the shell 22. The plates are closely circumferentially spaced into segmental groups of baskets. The baskets are mounted intermediate radial wall partitions 25 and chordal wall partitions 26. The baskets are radially and circumferentially arranged to complete a circle around the horizontal central shaft 24 so as to provide a large heating surface.

Air inlet and outlet ducts 27, 28, respectively, are provided at each end of the shell. The air inlet and outlet ducts include inlet and outlet hoods that are coaxially secured to the central shaft 24 for rotation with the shaft relative to the heat exchange mass 23. Each of the air inlet and outlet hoods have diametrically opposed sectors 29, 30 and 31, 32. Stationary gas inlet and outlet ducts 33, 34, respectively, are arranged around the respective outlet and inlet air hood sectors.

Figure 2:
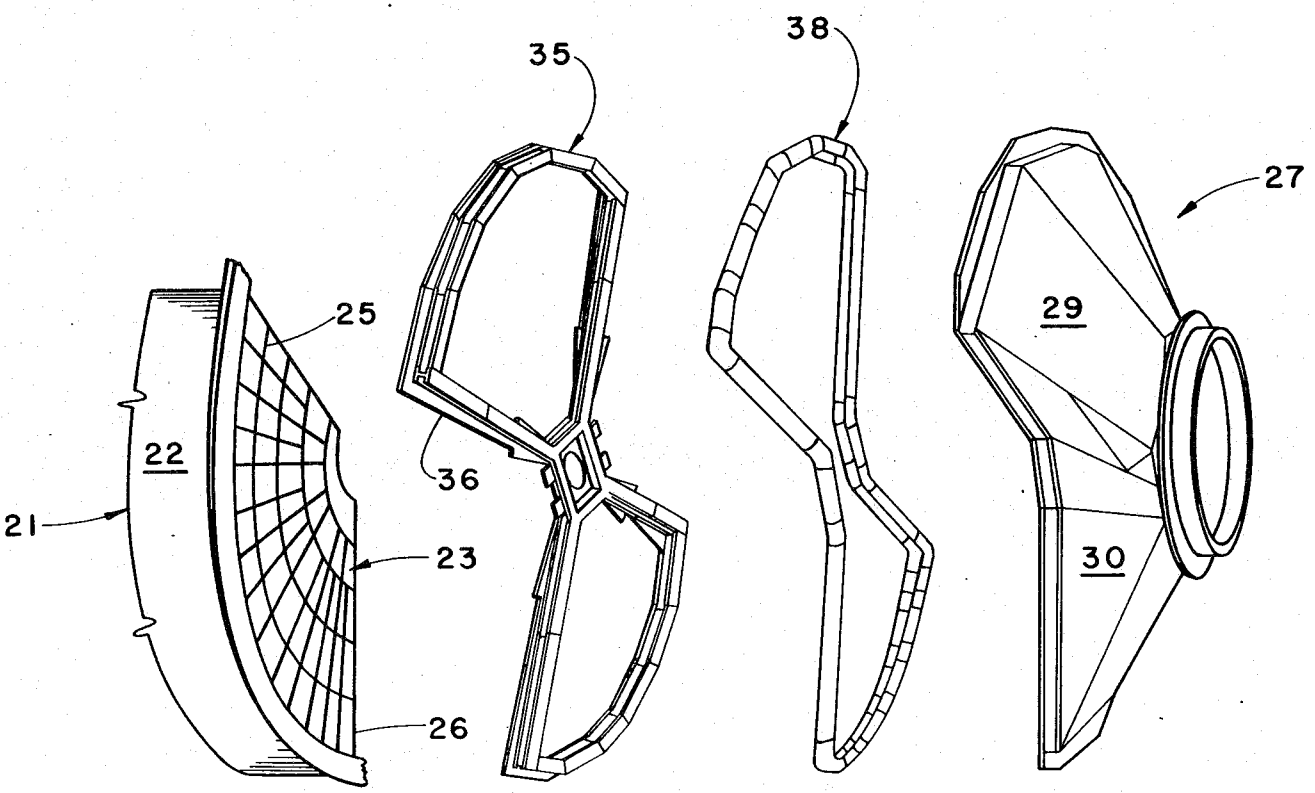
FIG. 2 is a schematic exploded representative of the primary rotating components of an air heater.

As best shown by FIG. 2, seal frames 35 are operatively disposed along the peripheries of the air duct hood sectors and each supports a sealing strip 36. The seal frames rotate with each of the respective air duct hoods in fluid-tight relationship against the opposite end faces of the stator 21.

As illustrated by flow arrow 120 in FIG. 3, combustion air enters the air heater through a central collar of a first air duct 27 and is split into two axial streams 120*a* and 120*b* which pass into the diametrically opposed sectors 29, 30 respectively. The air streams pass through circumferential spaced segments of the heat exchange mass 23 into axially opposite radial segments 31, 32 and are merged into the full air stream 120 and discharged through an air outlet duct 28. Flue gas, as illustrated by flow arrow 130 in FIG. 3, passes through the air heater in counterflow relationship relative to the combustion air flow. The flue gas stream 130 passes over the outer surfaces of the air outlet hood segments 31, 32 and into the portions of the heat exchange mass 23 which, at that time, are not axially aligned in fluid communication with the air duct hood segments 29-32. The flue gas stream exits form the heat exchange mass 23 and is discharged via the outlet duct 34.

Figure 5:
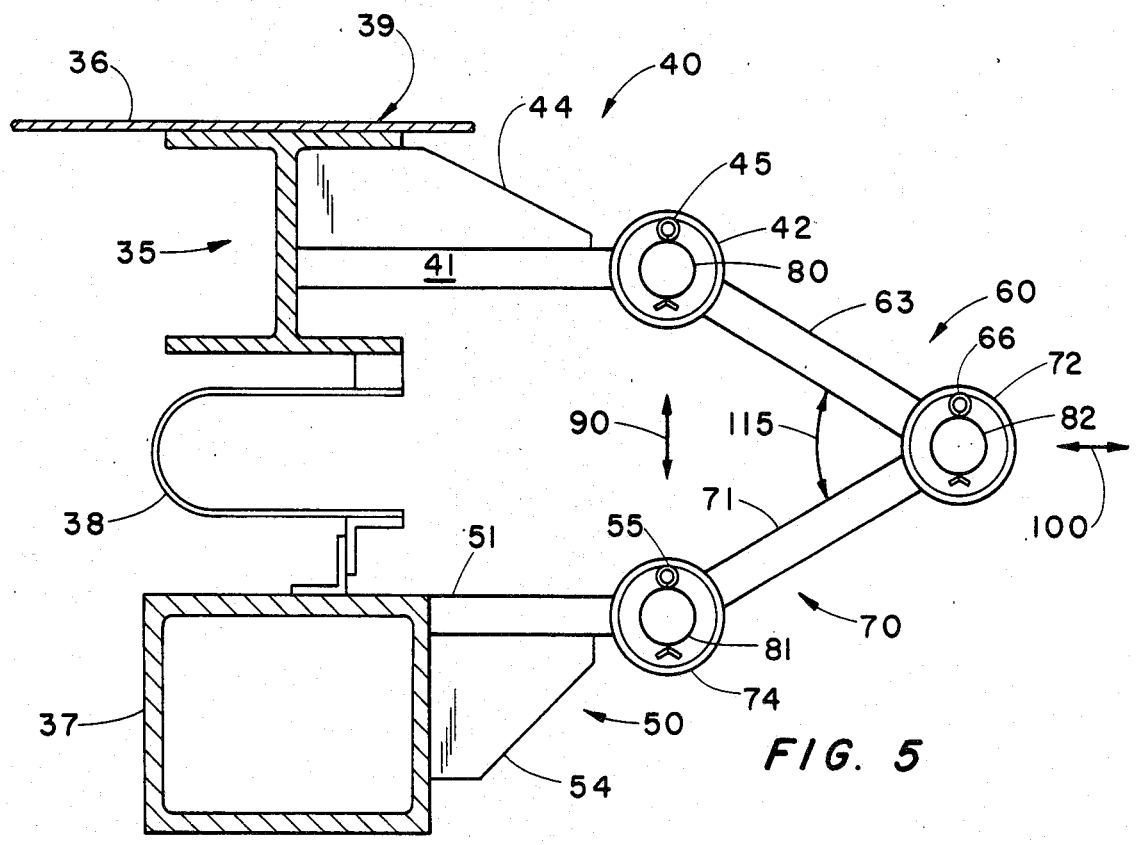
FIG. 5 is a foreshortened end view, partly in section, of the intermediate linkage taken along lines 5—5 of FIG. 4.

In accordance with the invention, as is best shown in FIG. 5, a seal frame support linkage 39 is operatively interconnected in the axial space between the seal frame 35 and a hood frame 37.

The seal frame 35 is an endless member designed to carry the sealing strip 36 against the end of a stationary heating mass 23. Each hood frame 37, which is part of a respective one of the air duct hoods, is also flexibly connected to the seal frame 35 by an expansion joint 38 that has a U-shaped cross-section.

The seal frame support linkage 39 is comprised of two laterally extending brackets or plates 40, 50, which are rigidly attached to the seal frame 35 and hood frame 37, respectively. The plates 40, 50 are parallel to each other, and their lateral centerlines and lateral outer edges are substantially axially aligned. Links 60 and 70 are pivotally connected the plates 40, 50, and to each other, to provide a structural framework for coplanar movement of the seal frame 35 and hood frame 37 relative to each other.

In operation, a plurality of seal frame support linkages 39 are mounted around the seal frame support at spaced intervals as shown in FIG. 1. The physical arrangement of the linkage allows coplanar axial expansion and contraction of the seal frame and duct frame in the axial direction illustrated by double arrow 90 in FIG. 5 with the attendant lateral movement of the links 60 and 70 and their connection as shown by double arrow 100 in FIG. 4.

Figure 6:
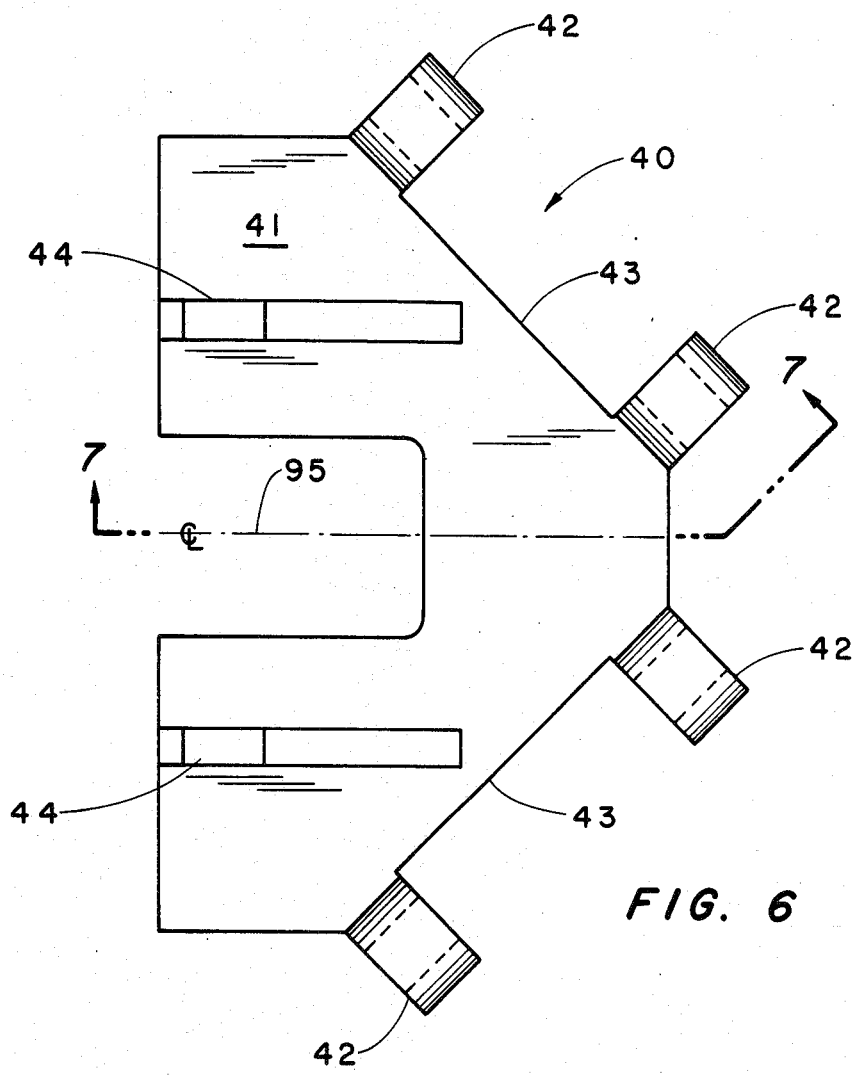
FIG. 6 is a plan view of a seal frame plate.
Figure 7:
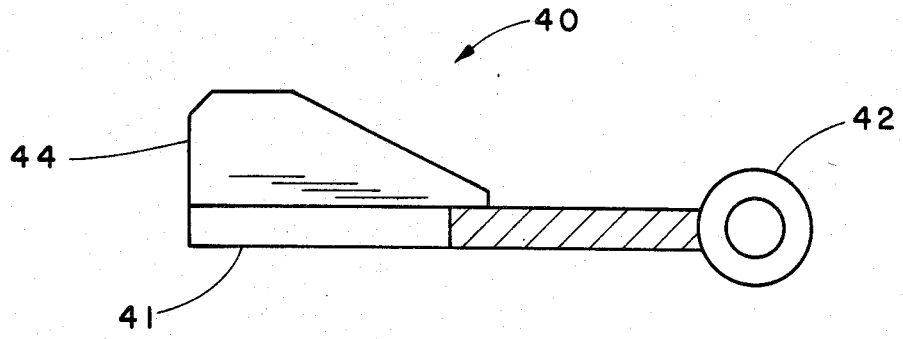
FIG. 7 is a partial sectional view of the seal frame plate taken along lines 7—7 of FIG. 6.

The seal frame plate 40, as shown in FIGS. 6 and 7, is comprised essentially of a central plate 41 having pairs of spaced support rings 42 mechanically secured to lateral outer edges 43 of the central plate 41. The support rings 42 are designed to closely receive and support a hinge pin 80 (see FIG. 5) extending through the link 60 as described hereafter. The plate 40 also includes two gusset plates 44 which are designed to be seldably connected to the seal frame 35.

Figure 4:
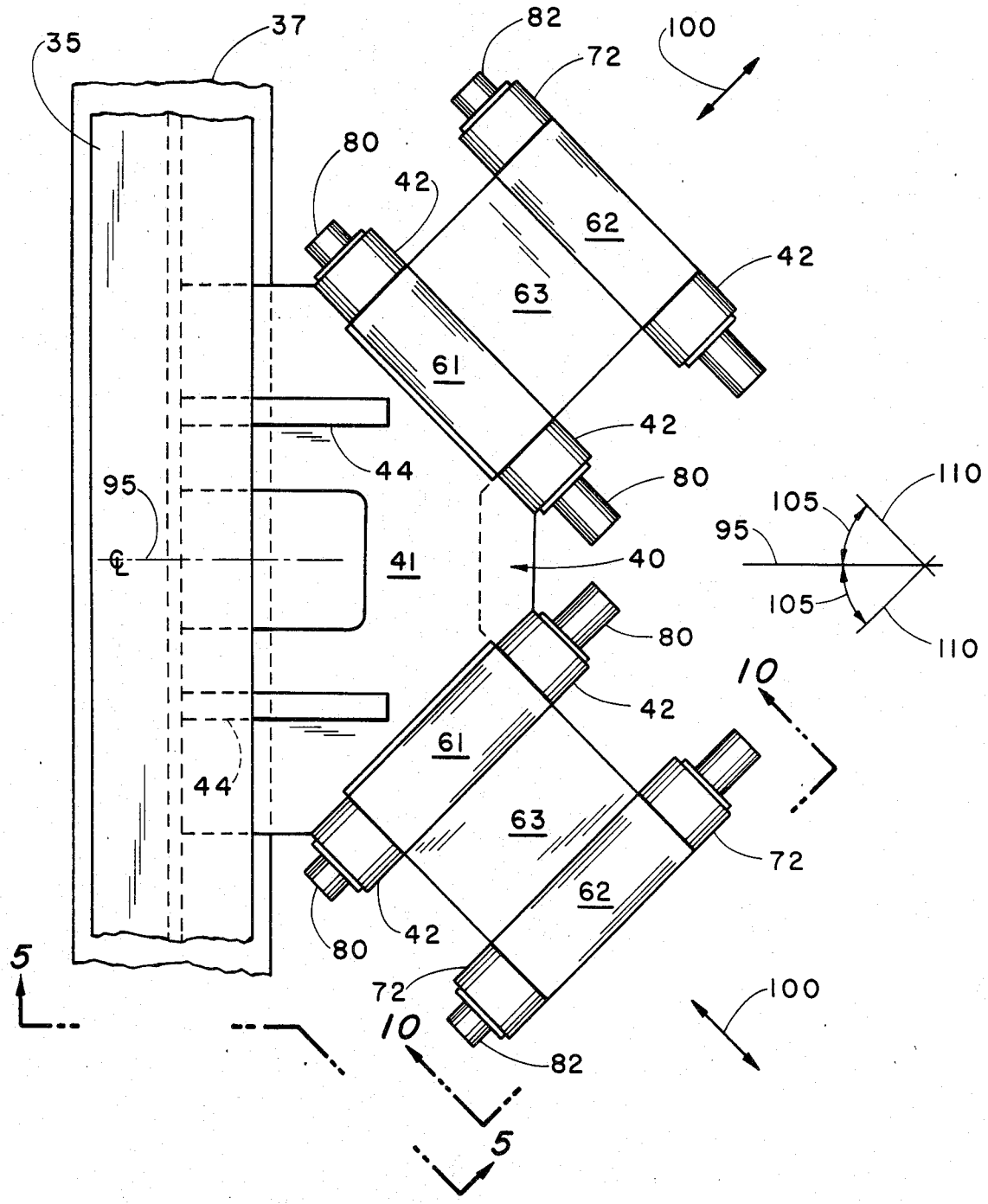
FIG. 4 is an elevation view of an intermediate linkage, according to the invention, connecting a seal frame and a hood frame (both shown in part)
Figure 10:
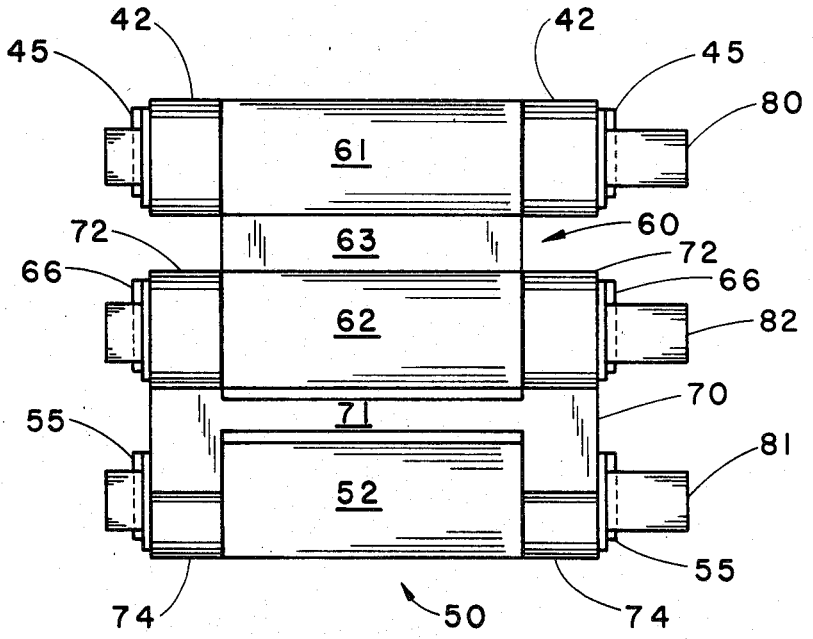
FIG. 10 is a side view of a portion of the seal frame plate taken along lines 10—10 of FIG. 4.
Figure 8:
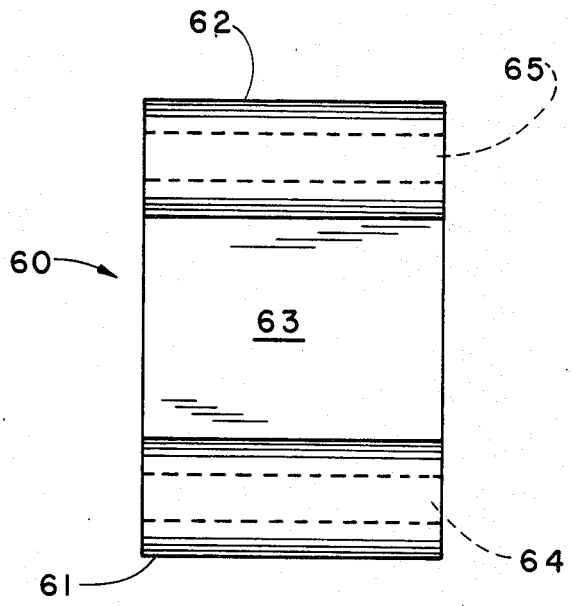
FIG. 8 is a plan view of a first link.
Figure 9:
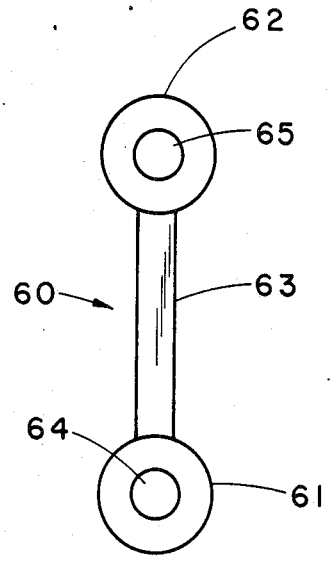
FIG. 9 is an end view of the first link of FIG. 8.

The link 60, as illustrated in FIGS. 8 and 9, includes two parallel tubular portions 61 and 62 rigidly interconnected by a web plate portion 63. Each of the tubular portions 61, 62 includes a bore 64, 65 extending therethrough. When the seal frame support linkage is assembled, the tubular portion 61 is located between the two rings 42 as shown in FIGS. 4 and 10. The bore 64 of the tubular portion 61 is axially coincident with the opening of the rings 42 so that a hinge pin 80 can be inserted through the bore 64 and the hole of the rings 42 to pivotally interconnect link 60 with the seal frame plate 40. As shown on FIG. 5 cotter pins 45, or the like, are driven into holes at the ends of the pivot pins 80 to secure the pivot pins in position. Other well known means can be utilized.

Figure 11:
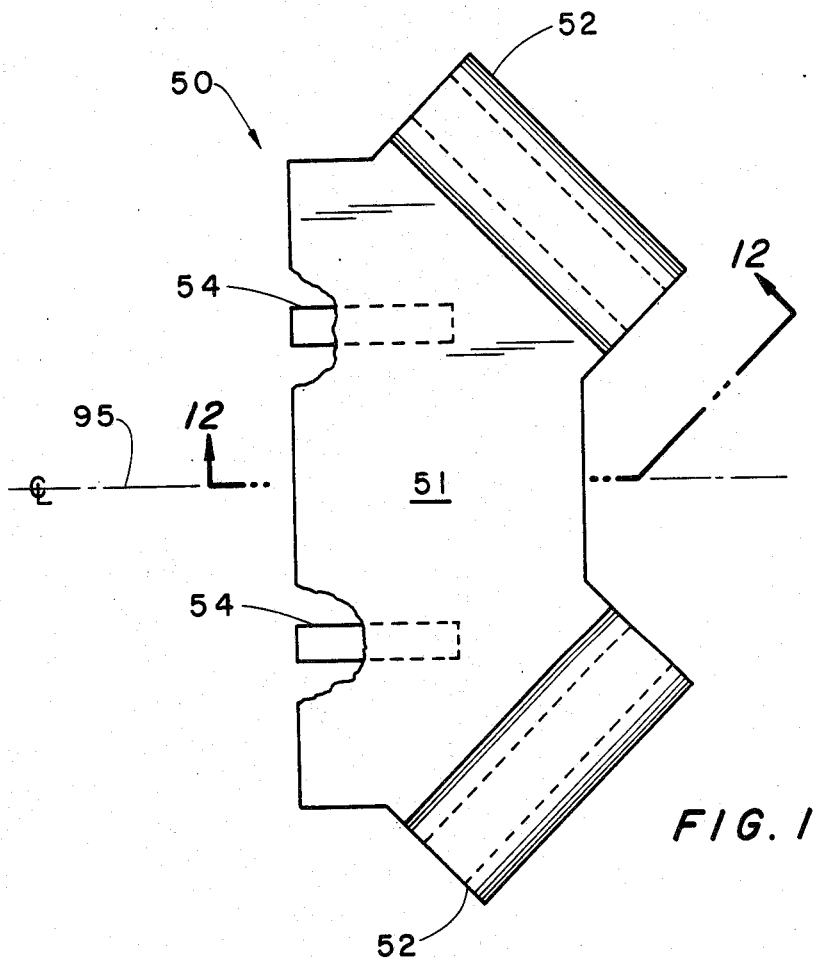
FIG. 11 is a plan view of a hood frame plate parTly broken away.
Figure 12:
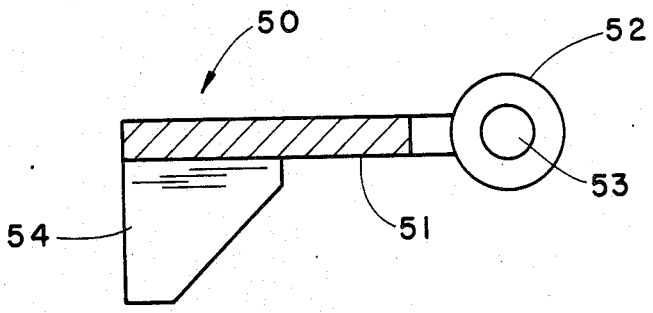
FIG. 12 is a side view, partly in section, of the hood frame plate taken along lines 12—12 of FIG. 11.

The hood frame plate 50, as shown in FIGS. 11 and 12, is composed of central plate 51 having tubular portions 52 mechanically secured along lateral edges of the central plate 51. The tubular portions 52 each have a bore 53 extending therethrough for receiving a hinge pin 81, FIG. 5 for pivotally interconnecting the plate 50 to link 70 as described hereinafter. Gusset plates 54 depending from central plate 51 are provided for angularly connecting the central plate to the hood frame.

Figure 13:
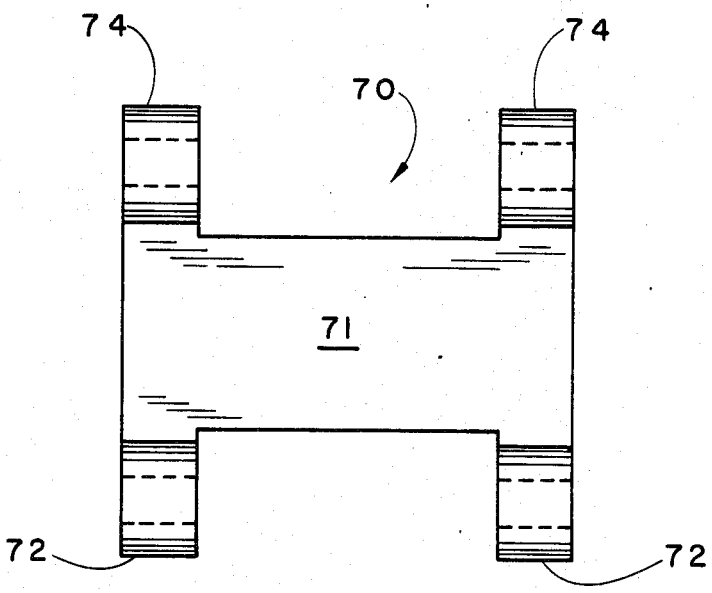
FIG. 13 is a plan view of a second link of the inventive linkage.
Figure 14:
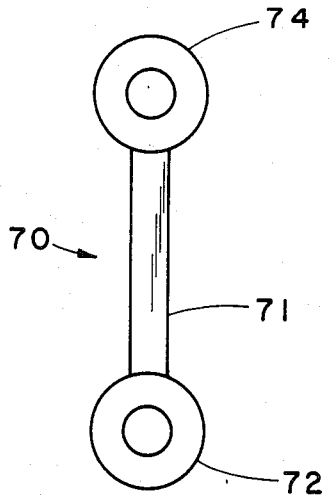
FIG. 14 is an end view of the second link of FIG. 13.

FIGS. 13 and 14 illustrate the link 70. The link 70 comprises a rectangular plate 71 having pairs of spaced rings 72, 74 rigidly connected at opposite ends of the lengthwise edges of the rectangular plate 71. As shown in FIG. 10, the tubular portion 52 of plate 50 is arranged coaxially between a pair of spaced rings 74 and the plate 50 is pivotally interconnected with the link 70 via a hinge pin 81, which is fixed at each end by cotter pins 55.

The ends of the links 60 and 70 opposite to the plates 40, 50 to which each is connected are pivotally connected by arranging the tubular portion 62 intermediate the spaced rings 72 and placing a pin 82 therethrough, as shown in FIG. 10. The pin 82 is secured at each end by cotter pins 66. The three hinge pins 80, 81, 82 are arranged parallel to each other.

In the preferred embodiment, as is illustrated in particular in FIGS. 4 and 5, the laterally extending plates 40 and 50 are rigidly connected in cantilevered fashion at one end to the seal frame 35 and hood frame 37, respectively. As shown in FIG. 4, the plates 40, 50 have axially aligned lateral centerlines 95, as illustrated in FIG. 4, extending through the plates from the respective frames 35, 37. The plates 40, 50 are formed with edges, angled in respect of, and symmetrically extending on opposite sides of the centerlines 95. The respective plate rings 42 of plate 40 and tubular portions 52 of plate 50 are mounted to the angled edges. The respective gusset plates 44, 54 are also symmetrically disposed on opposite sides of the lateral centerline of the respective plates 40, 50.

The pivot axes of the links and plate on opposite sides of the lateral centerline 95 of the linkage 39 are oriented and extend equiangularly relative to the lateral centerline 95. In a preferred embodiment, as shown in FIGS. 4 or 5, or both, the axes 110 of the hinge pins 80, 81, 82 are disposed at an angle 105 of forty-five degrees relative to the lateral centerline 95 of the plates 40, 50. In the equilibrium position, illustrated in Figures, the plate portion 63 of link 60 and the plate 71 of link 70 are spaced at an angle 115 of sixty degrees.

It will be evident to those skilled in the art that changes may be made without departing from the spirit of the invention disclosed herein. For example, orientation of the plates or linkages connections could be reversed so that, with appropriate dimensional changes, the form of the plate generally referred to as the seal frame plate could be connected to the hood frame and the form of the hood frame plate could be adopted to be connected to the seal frame.

The embodiments of the invention in which an exclusive property or privilege is claimed are defined as follows:

1. In a regenerative air heater of the type having an open-ended cylindrical shell disposed about an elongated central axis with open axially spaced cylindrical end faces, a stationary heat exchange mass mounted within the shell, air ducts coaxially mounted at each end of the shell for rotation relative to the heat exchange mass, means for sealing the air ducts in fluid-tight engagement against the end faces, said sealing means including a seal frame, a hood frame axially spaced from the seal frame attached to each air duct, and an intermediate linkage connecting the seal frame and the hood frame, the improvement wherein the intermediate linkage comprises a first plate extending laterally, relative to the axis, from the seal frame, a second plate extending laterally from the hood frame, and link means pivotally supported by and maintaining the first and second plate in parallel relationship to each other for axial coplanar relative movement, the link means comprising a first link pivotally connected at one end to the first plate, and a second link pivotally connected at one end to the second plate and pivotally connected at an opposite end to an end of the first link opposite the end of the first link which is connected to the first plate.

2. The improvement as recited in claim 1 wherein the first plate includes a pair of spaced rings, projecting from the first plate, and the first link includes a pair of tubular members and a membrane interconnected between said tubular members, and wherein the link means includes a plurality of pivot pins, one of said tubular members of the first link being mounted intermediate the spaced rings of the first plate privotally connected thereto by one of said pivot pins, and wherein the second plate comprises a tubular portion projecting from the second plate, the second link including a first pair of spaced rings at opposite sides of the tubular portion of the second plate pivotally connected thereto by one of the pivot pins.

3. The improvement as recited in claim 2 wherein two separate link means are mounted to the first and second plates symmetrically about axially aligned lateral centerlines extending through the plates from the respective frames.

4. The improvement as recited in claim 3 wherein the pivot pins each have an elongated axis which extends relative to the lateral centerlines at an equal angle.

* * * * *